US007465183B2

(12) United States Patent
Hashiguchi et al.

(10) Patent No.: US 7,465,183 B2
(45) Date of Patent: Dec. 16, 2008

(54) ELECTRICAL CONNECTOR WHICH HAS A WIRE ALIGNING FUNCTION AND WHICH CAN BE REDUCED IN SIZE

(75) Inventors: Osamu Hashiguchi, Tokyo (JP); Yoshihide Kuroki, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/974,560

(22) Filed: Oct. 15, 2007

(65) Prior Publication Data

US 2008/0090460 A1 Apr. 17, 2008

(30) Foreign Application Priority Data

Oct. 16, 2006 (JP) ..... 2006-281381

(51) Int. Cl.
*H01R 11/20* (2006.01)

(52) U.S. Cl. ..... 439/405; 439/579; 439/942

(58) Field of Classification Search ..... 439/579, 439/701, 942, 403–405
See application file for complete search history.

(56) References Cited

U.S. PATENT DOCUMENTS 4,099,822 A * 7/1978 Carlisle et al. ..... 439/405
5,118,306 A 6/1992 Bixler et al.
6,129,594 A * 10/2000 Lai ..... 439/701
6,790,087 B2 * 9/2004 Ho ..... 439/942
7,029,314 B2 4/2006 Muro et al.
2007/0111555 A1 5/2007 Neumetzler

FOREIGN PATENT DOCUMENTS

JP 5-182713 7/1993
JP 2004-335221 11/2004
WO WO 2005/020376 3/2005

OTHER PUBLICATIONS

Japanese Office Action dated Sep. 3, 2008.

* cited by examiner

*Primary Examiner*—Tho D Ta
(74) *Attorney, Agent, or Firm*—Collard & Roe, P.C.

(57) ABSTRACT

In a connector for being connected to a plurality of wires, a plurality of contacts are held by a housing and arranged in parallel in a first direction. The contacts have connecting portions to be connected to the wires. The connector includes an aligning member for aligning and holding the wires. The aligning member defines a plurality of through holes arranged in parallel in the first direction and extending in a second direction perpendicular to the first direction. The through holes allow the connecting portions to be inserted therethrough. The aligning member includes a comb-like portion formed at one end in a third direction perpendicular to the first and the second directions and adapted to hold the wires, and a plurality of positioning portions formed at the other end in the third direction and arranged in parallel in the first direction. The positioning portions are for positioning the wires.

16 Claims, 5 Drawing Sheets

ELECTRICAL CONNECTOR WHICH HAS A WIRE ALIGNING FUNCTION AND WHICH CAN BE REDUCED IN SIZE

This application is based upon and claims the benefit of priority from Japanese patent application No. 2006-281381, filed on Oct. 16, 2006, the disclosure of which is incorporated herein in its entirety by reference.

BACKGROUND OF THE INVENTION

This invention relates to a connector to be connected to a plurality of wires and, in particular, to a connector having a wire aligning function.

For example, Japanese Unexamined Patent Application Publication (JP-A) No. H5-182713 discloses a connector with a guide portion having a wire aligning function. The guide portion comprises a pair of guide members having a generally rectangular shape. The guide members are provided with a number of projections (a comb-like portion) formed on confronting sides and extending in a height (thickness) direction of each guide member to hold a plurality of wires, respectively. In this connector, however, a large number of components are required. Further, it is difficult to reduce the size of the connector in the height direction.

SUMMARY OF THE INVENTION

It is therefore an exemplary object of this invention to provide a connector with a wire aligning function, which has a small number of components and which can be reduced in size.

Other objects of the present invention will become clear as the description proceeds.

According to an exemplary aspect of the present invention, there is provided a connector adapted to be connected to a plurality of wires, the connector comprising a plurality of contacts arranged in parallel in a first direction and having connecting portions to be connected to the wires, a housing holding the contacts, and an aligning member for aligning and holding the wires, the aligning member having a plurality of through holes arranged in parallel in the first direction and extending in a second direction perpendicular to the first direction, the through holes allowing the connecting portions to be inserted therethrough, a comb-like portion formed at one end in a third direction perpendicular to the first and the second directions and adapted to hold the wires; and a plurality of positioning portions formed at the other end in the third direction and arranged in parallel in the first direction, the positioning portions being for positioning the wires.

DESCRIPTION OF THE EXEMPLARY EMBODIMENT

Figure 1:
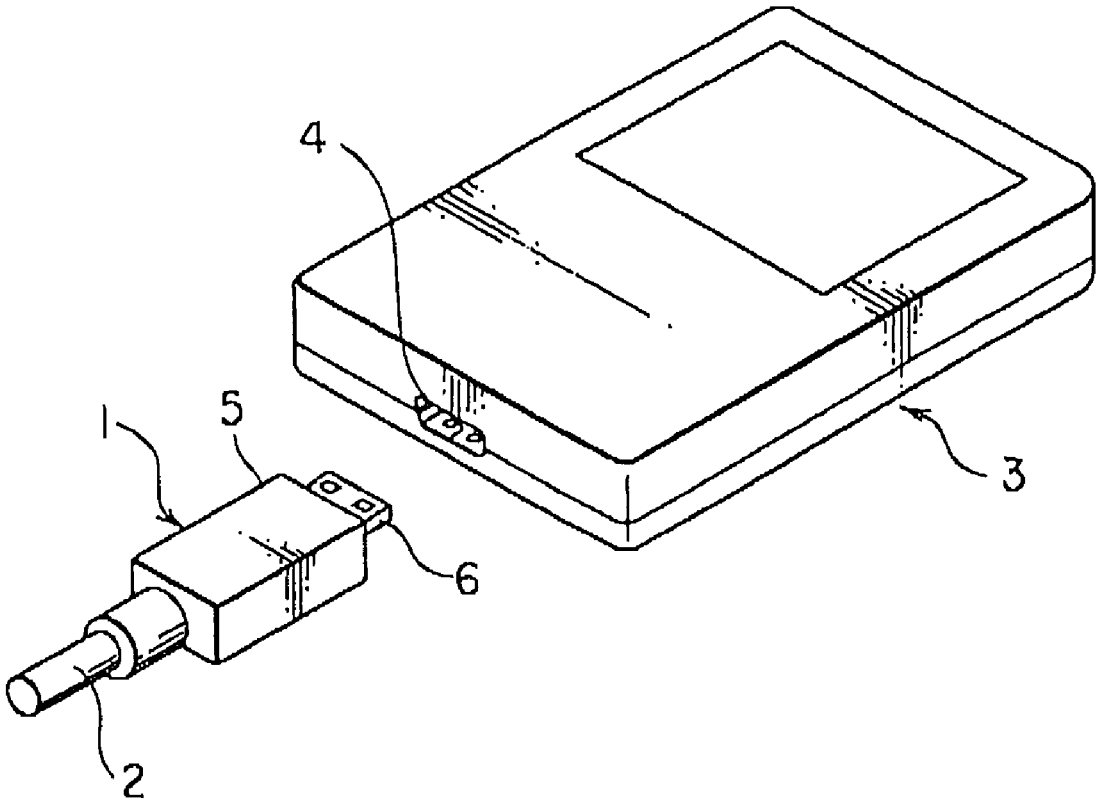
FIG. 1 is a perspective view showing a connector according to an exemplary embodiment of this invention together with a connection object, when the connector is connected to a cable.

Referring to FIG. 1, a connector 1 according to an exemplary embodiment of this invention is connected to a cable 2 and is shown together with a mobile apparatus 3 as a connection object. The mobile apparatus 3 has a receptacle-type connector 4. The connector 1 is a plug-type connector and has a casing 5 and a fitting portion 6 protruding from the casing 5. When the connector 1 is connected to the mobile apparatus 3, the fitting portion 6 is fitted to the connector 4.

Figure 2:
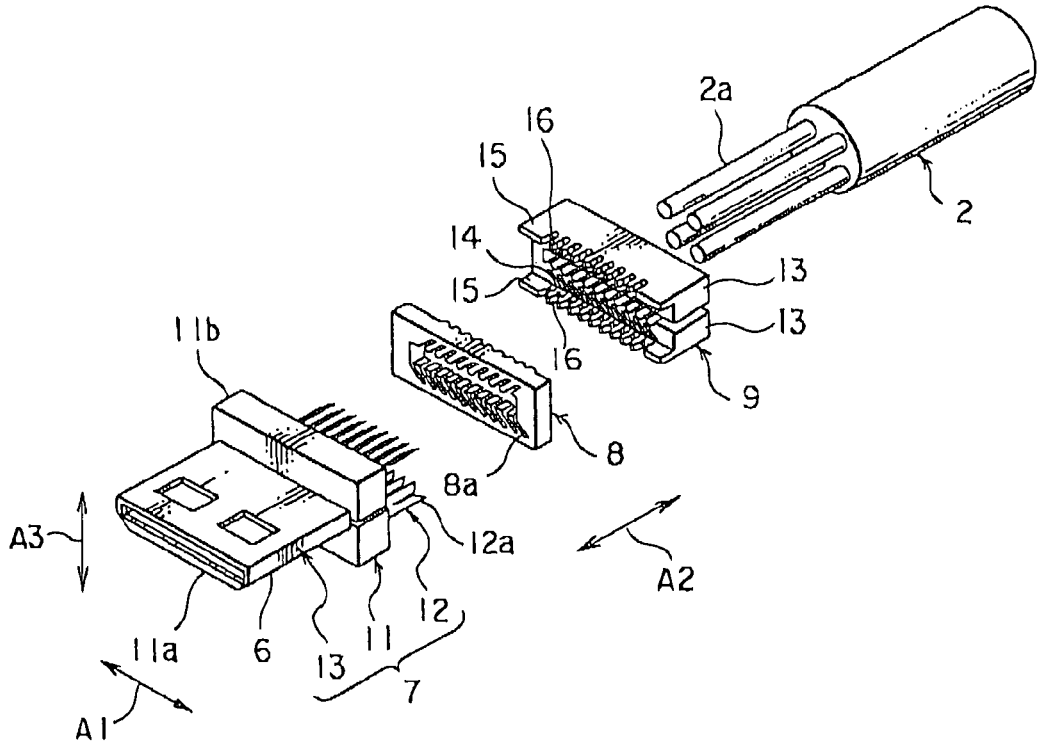
FIG. 2 is an exploded perspective view showing various components of the connector illustrated in FIG. 1 together with a cable.

Referring to FIG. 2 in addition, the connector 1 has various components, i.e., a terminal set 7, a protector 8, and a locator 9, which are fixed to the casing 5. In the figure, these components are shown in an exploded state, together with the cable 2. For convenience of illustration, these components and the cable 2 are illustrated in an orientation opposite to that in FIG. 1.

The terminal set 7 has one part received inside the casing 5 and the other part as the fitting portion 6 protruding from the casing 5. Each of the protector 8 and the locator 9 is made of an insulating material and received inside the casing 5. As will later be described in detail, the locator 9 serves as an aligning member for aligning and holding wires 2*a* of the cable 2.

The terminal set 7 comprises a housing 11 made of an insulating material, a plurality of conductive contacts 12 held by the housing 11 and arranged in two rows at a predetermined pitch in a first direction A1, and a conductive shell 13 surrounding an outer periphery of a protruding portion 11*a* protruding frontward of the housing 11. Each of the contacts 12 has a connecting portion 12*a* protruding rearward from a flange portion 11*b* of the housing 11. The connecting portion 12*a* has a branched part and is adapted to be connected to a wire inserted therebetween. The contacts 12 in one row and the other row are shifted in position from each other by a half of the predetermined pitch.

The protector 8 has a generally rectangular shape. The protector 8 is disposed between the housing 11 and the locator 9 in a second direction A2 perpendicular to the first direction A1, and clamps the wires 2*a* in cooperation with the locator 9. The protector 8 has a plurality of through holes 8*a* allowing insertion of the contacts 12, in particular, the connecting portions 12*a*. These through holes 8*a* are arranged in conformity with the arrangement of the connecting portions 12*a*.

Figure 3:
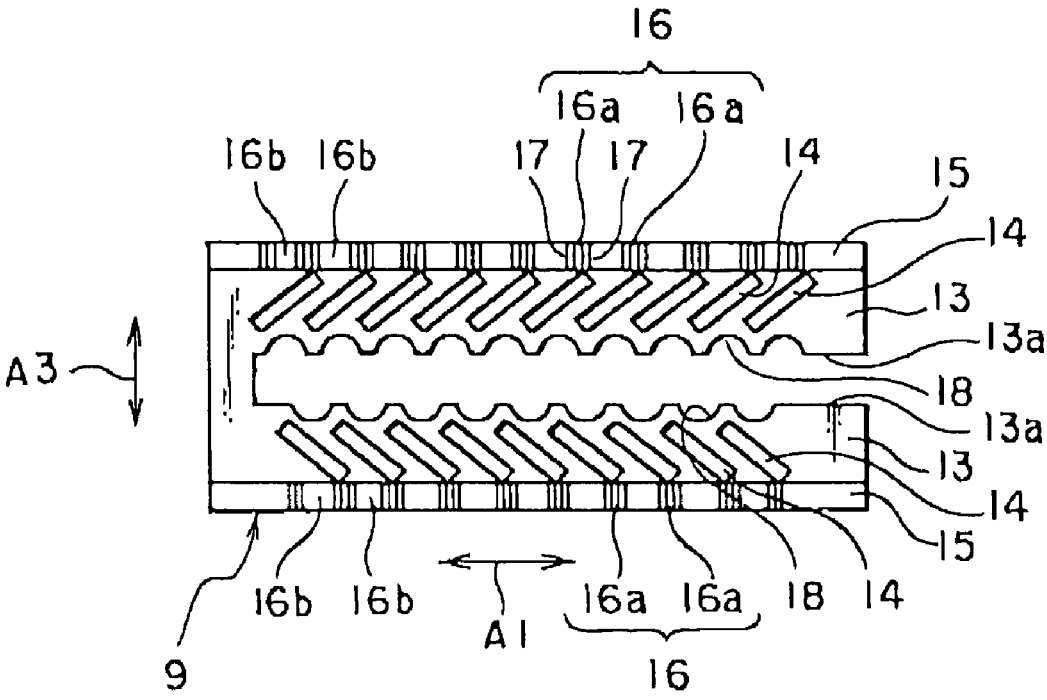
FIG. 3 is a front view of an aligning member included in the various components illustrated in FIG. 2.
Figure 4:
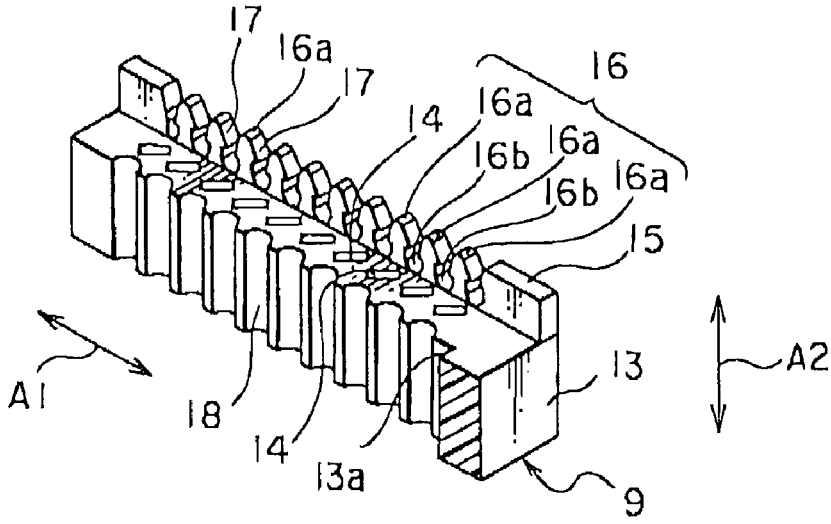
FIG. 4 is a sectional perspective view of the aligning member in FIG. 3.

Referring to FIGS. 3 and 4 also, the locator 9 will be described in detail.

The locator 9 has a generally rectangular shape and comprises a pair of aligning portions 13 faced to each other in a third direction A3. Each of the aligning portions 13 has a plurality of through holes 14 arranged in conformity with the arrangement of the connecting portions 12*a*, extending in the second direction A2, and allowing insertion of the connecting portions 12*a* of the contacts 12, respectively. Each of the through holes 14 has a substantially rectangular shape in section.

As best shown in FIG. 3, the rectangular shape of the through hole 14 has a longitudinal direction inclined at a predetermined angle with respect to the first and the third directions A1 and A3. In order to enable the connecting portions 12*a* of the contacts 12 to be inserted into the through holes 14, the connecting portions 12*a* of the contacts 12 and the through holes 8*a* of the protector 8 are inclined also at the above-mentioned predetermined angle with respect to the first and the third directions A1 and A3.

The aligning portions 13 further have protruding portions 15, respectively, which are formed on outer edges thereof in the third direction A3 and extend in the second direction A2 towards the protector 8. Each of the protruding portions 15 is provided with a comb-like portion 16 for holding the wires 2*a*. The comb-like portion 16 includes a plurality of teeth 16*a* arranged at the predetermined pitch in the first direction A1. Spaces between every adjacent ones of the teeth 16*a*, i.e., a plurality of holding grooves 16*b* are located at positions corresponding to the through holes 14 in the third direction A3. These holding grooves 16*b* serve to hold the wires 2*a*. Each of the teeth 16*a* has a pair of engaging portions 17 for engaging the wire 2*a* to prevent the wire 2*a* from being released from the holding groove 16*b*.

The aligning portions 13 have confronting surfaces 13*a* provided with a plurality of positioning portions 18 arranged at the predetermined pitch in the first direction A1. Each of the positioning portions 18 comprises a channel having a semicircular section and extending in the second direction A2. The positioning portions 18 serve to position the wires 2*a*. The rectangular shape of each through hole 14 has a longitudinal one end arranged at a position between adjacent ones of the positioning portions 18. Specifically, the positioning portions 18 are formed at positions corresponding to the holding grooves 16*b* in the third direction A3, respectively.

Figure 5:
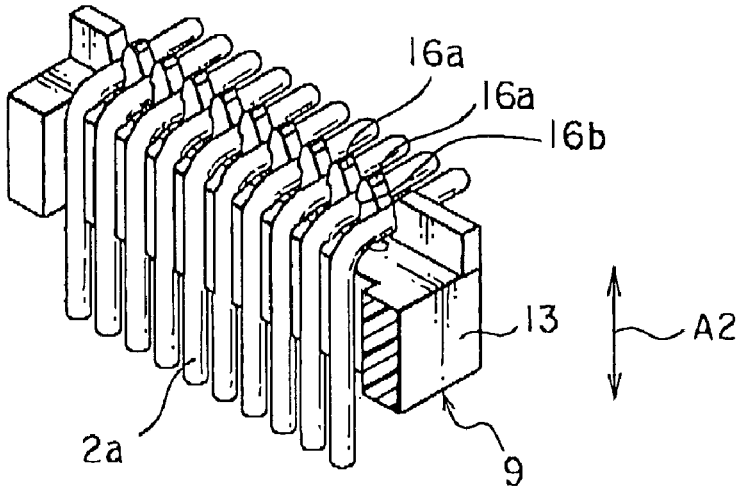
FIG. 5 is a sectional perspective view of the aligning member when wires of the cable are fixed thereto.

Referring to FIG. 5 in addition, description will be made of connection of the wires 2*a* to the connector 1.

Each of the wires 2*a* comprises a conductive core coated with an insulating coating. The wires 2*a* are inserted between every adjacent ones of the aligning portions 13. Then, the aligning portions 13 are moved towards each other. By the positioning portions 18, the wires 2*a* are positioned in two rows. The wires 2*a* in each row are perpendicularly bent outward and pushed into the holding grooves 16*b* as illustrated in FIG. 5. By the help of elasticity of the coating, the wires 2*a* are inserted into the holding grooves 16*b* and prevented by the engaging portions 17 from being released. Thus, the wires 2*a* properly positioned are securely held by the locator 9.

In the above-mentioned state, the connecting portions 12*a* of the contacts 12 are pressed against the wires 2*a* through the through holes 8*a* of the protector 8. Then, the branched part of each of the connecting portions 12*a* cuts the coating of the wire 2*a* and is inserted into the through hole 14 of the locator 9. As a consequence, the connecting portions 12*a* are electrically connected to the cores of the wires 2*a*.

After the wires 2*a* are connected to the contacts 12, the terminal set 7, the protector 8, and the locator 9 are fixed to the casing 5. Thus, the connector 1 illustrated in FIG. 1 is provided.

The aligning portions 13 are integrally formed. Not being limited thereto, the aligning portions may be formed as separate components.

Figure 6:
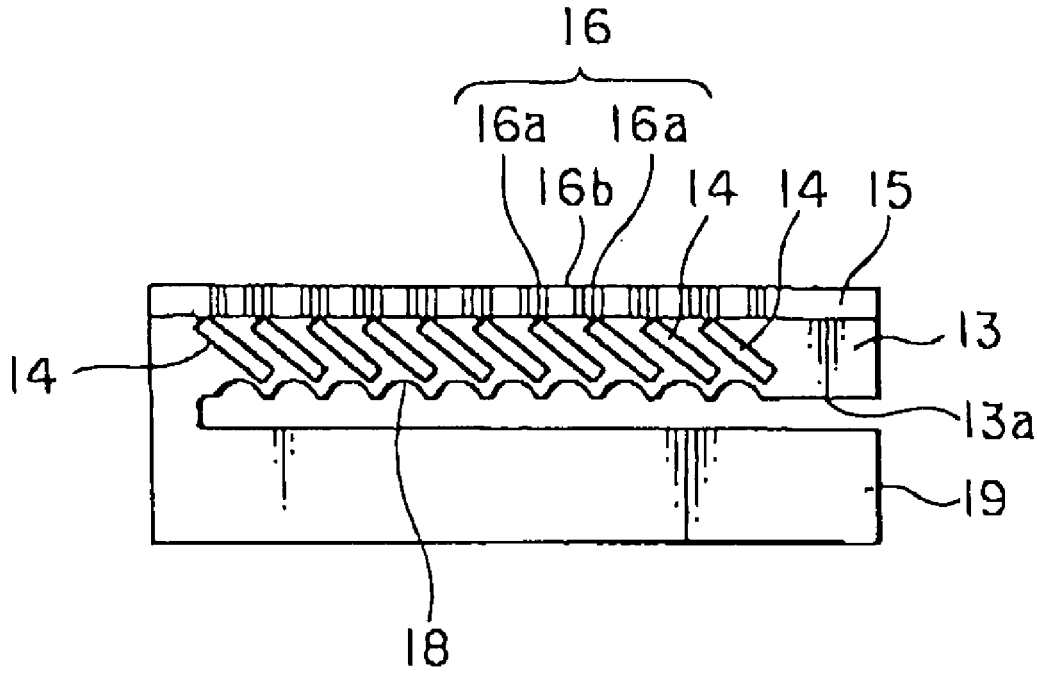
FIG. 6 is a front view of a modification of the aligning member.

In the foregoing, the locator 9 includes a pair of the aligning portions 13. Alternatively, if the connecting portions 12*a* of the contacts 12 are arranged in a single row, one of the aligning portions 13 may be replaced by a flat portion 19 as illustrated in FIG. 6. In this case also, the wires 2*a* are inserted between the aligning portion 13 and the flat portion 19 and, thereafter, the aligning portion 13 and the flat portion 19 are moved towards each other. By the positioning portions 18, the wires 2*a* are positioned in a single row. Further, the wires 2*a* are perpendicularly bent outward and pushed into the holding grooves 16*b*. Thus, the wires 2*a* properly positioned are securely held by the locator 9.

While the present invention has thus far been described in connection with the exemplary embodiments thereof, it will readily be possible for those skilled in the art to put this invention into practice in various other manners.

What is claimed is:

1. A connector adapted to be connected to a plurality of wires, the connector comprising:

a plurality of contacts arranged in parallel in a first direction and having connecting portions to be connected to the wires;

a housing holding the contacts; and an aligning member for aligning and holding the wires;

the aligning member having:

a plurality of through holes arranged in parallel in the first direction and extending in a second direction perpendicular to the first direction, the through holes allowing the connecting portions to be inserted therethrough;

a comb-like portion formed at one end in a third direction perpendicular to the first and the second directions and adapted to hold the wires; and a plurality of positioning portions formed at the other end in the third direction and arranged in parallel in the first direction, the positioning portions being for positioning the wires;

wherein each of the through holes has a substantially rectangular shape in section, the rectangular shape having one end in a longitudinal direction, the one end being disposed at a position corresponding to a space between adjacent ones of the positioning portions; and wherein the longitudinal direction of the rectangular shape is inclined with respect to the first and the third directions.

2. The connector according to claim 1, wherein the comb-like portion includes a plurality of teeth spaced from one another in the first direction, the wires being held between every adjacent ones of the teeth.

3. The connector according to claim 2, wherein the teeth include engaging portions for engaging the wires to prevent the wires from being released, respectively.

4. The connector according to claim 2, wherein the aligning member includes a pair of aligning portions faced to each other in the third direction, the through holes, the comb-like portion, and the positioning portion being provided in at least one of the aligning portions.

5. The connector according to claim 4, wherein the positioning portions are formed on confronting faces of the aligning portions.

6. A connector adapted to be connected to a plurality of wires, the connector comprising:

a plurality of contacts arranged in parallel in a first direction and having connecting portions to be connected to the wires;

a housing holding the contacts; and an aligning member for aligning and holding the wires;

the aligning member having:

a plurality of through holes arranged in parallel in the first direction and extending in a second direction perpendicular to the first direction, the through holes allowing the connecting portions to be inserted therethrough;

a comb-like portion formed at one end in a third direction perpendicular to the first and the second directions and adapted to hold the wires; and a plurality of positioning portions formed at the other end in the third direction and arranged in parallel in the first direction, the positioning portions being for positioning the wires;

the connector further comprising a protector disposed between the housing and the aligning member in the second direction, the aligning member and the protector clamping the wires in cooperation with each other.

7. The connector according to claim 6, wherein the protector has a through hole allowing insertion of the contacts.

8. The connector according to claim 6, wherein the comb-like portion includes a plurality of teeth spaced from one another in the first direction, the wires being held between every adjacent ones of the teeth.

9. The connector according to claim 8, wherein the teeth include engaging portions for engaging the wires to prevent the wires from being released, respectively.

10. The connector according to claim 8, wherein the aligning member includes a pair of aligning portions faced to each other in the third direction, the through holes, the comb-like portion, and the positioning portion being provided in at least one of the aligning portions.

11. The connector according to claim 10, wherein the positioning portions are formed on confronting faces of the aligning portions.

12. A connector adapted to be connected to a plurality of wires, the connector comprising:

a plurality of contacts arranged in parallel in a first direction and having connecting portions to be connected to the wires;

a housing holding the contacts; and an aligning member for aligning and holding the wires;

the aligning member having:

a plurality of through holes arranged in parallel in the first direction and extending in a second direction perpendicular to the first direction, the through holes allowing the connecting portions to be inserted therethrough;

a comb-like portion formed at one end in a third direction perpendicular to the first and the second directions and adapted to hold the wires; and a plurality of positioning portions formed at the other end in the third direction and arranged in parallel in the first direction, the positioning portions being for positioning the wires;

wherein the aligning member includes a protruding portion formed at the one end and protruding towards the housing in the second direction, the comb-like portion being formed on the protruding portions.

13. The connector according to claim 12, wherein the comb-like portion includes a plurality of teeth spaced from one another in the first direction, the wires being held between every adjacent ones of the teeth.

14. The connector according to claim 13, wherein the teeth include engaging portions for engaging the wires to prevent the wires from being released, respectively.

15. The connector according to claim 13, wherein the aligning member includes a pair of aligning portions faced to each other in the third direction, the through holes, the comb-like portion, and the positioning portion being provided in at least one of the aligning portions.

16. The connector according to claim 15, wherein the positioning portions are formed on confronting faces of the aligning portions.

* * * * *